US005950887A

United States Patent [19]

Powell

[11] Patent Number: 5,950,887

[45] Date of Patent: Sep. 14, 1999

[54] BABY SLING

[76] Inventor: Karen L. Powell, R.D. 2, Box 41L, Palmyra, Pa. 17078

[21] Appl. No.: 09/076,092

[22] Filed: May 12, 1998

[51] Int. Cl.[6] ..... A45F 3/02; A47D 13/02

[52] U.S. Cl. ..... 224/158; 224/159; 224/602; 224/616

[58] Field of Search ..... 224/158, 159, 224/602, 616

[56] References Cited

U.S. PATENT DOCUMENTS

| | | | |
|---|---|---|---|
| D. 294,195 | 2/1988 | Starks . | |
| D. 306,655 | 3/1990 | Liebert . | |
| D. 332,865 | 2/1993 | Wilmink . | |
| 3,841,543 | 10/1974 | Bolton . | |
| 4,750,653 | 6/1988 | Prunty . | |
| 4,757,925 | 7/1988 | Knittel . | |
| 5,020,709 | 6/1991 | Hoaglan . | |
| 5,205,451 | 4/1993 | Manzer . | |
| 5,570,823 | 11/1996 | Lindy . | |
| 5,857,598 | 1/1999 | Dunne | 224/158 |

FOREIGN PATENT DOCUMENTS

| | | |
|---|---|---|
| 2371906 | 6/1978 | France . |
| 1560260 | 1/1980 | United Kingdom . |

OTHER PUBLICATIONS

William Sears, M.D., & Martha Sears, R.N., *The Baby Book* Ch. 14 (1993).

*Primary Examiner*—Linda J. Sholl
*Attorney, Agent, or Firm*—Robert C. Litman

[57] ABSTRACT

A baby sling having an elongated pouch of a double layer of fabric and a wide tail. The baby sling includes bumpers and a pillow located between the pouch fabric layers. A baby is held in the pouch against the caregiver's body. The pouch is wide for extra security. The baby sling has two rings through which the tail is looped for attachment. The bumpers are approximately cylindrical and may have drawstrings attached. The tail may have a zippered pocket.

7 Claims, 5 Drawing Sheets

BABY SLING

BACKGROUND OF THE INVENTION

1. Field of the Invention

The present invention relates generally to carriers for babies, and specifically to sling-type baby carriers.

2. Description of the Related Art

Babies enjoy being held much of the time. Holding a baby securely for more than a brief moment generally requires two hands. If the caregiver is standing or moving around, holding a baby is tiring since most of the baby's weight is on the arms. Since both hands are busy, it is difficult for a caregiver to accomplish other tasks while holding the baby.

Baby carriers of various designs are well known. One common type is the front pack type, which holds the baby against the caregiver's chest using a system of straps and buckles, with the baby's legs passing through a pair of leg holes. The baby may face either forward or backward.

Sling-type baby carriers are designed to be draped over one shoulder of a caregiver. Baby slings typically have a pouch for the baby, a strap or tail which loops around the caregiver, and an attachment for securing the carrier. The attachment may be a simple knot. A knot has the difficulty of being time-consuming to tie and untie when necessary. Various types of buckles and straps may be used for attachment. A common attachment is a pair of rings through which the tail is looped. With this type of attachment, the tail can slip out of the rings, allowing the baby to fall.

Typical baby slings have a pouch constructed of a single layer of fabric. This arrangement requires one or more seams at or close to the point where the pouch attaches to the attachment device. These attachment seams are under considerable strain when the baby is in the carrier. The attachment seams tend to rip out with prolonged use of the carrier.

A baby sling (sold under the trademark Over the Shoulder Baby Holder) is known in which a pillow is located between two layers of fabric continuous with the pouch fabric. In this sling the pouch fabric passes through two rings, the pouch fabric is folded around the pillow, and the attachment seams pass through the pillow. The pouch fabric is not folded in half and the pouch does not have two fabric layers. The pouch is relatively narrow, so that the baby may fall out. The bumpers are flat. The tail is narrow, and a stiffening rod is included at the end of the tail to prevent the tail slipping through the rings. The rod adds to the expense and complexity of the carrier, and can be uncomfortable for the user.

A baby sling is also known having single fabric layer construction, two locking rings, a shoulder pad, and a wide tail. Baby slings having locking buckles are well known. Other known slings include HoJo and Sling Ease.

U.S. Pat. No. 4,757,925 by Knittel discloses a sling-type baby carrier having a pouch and a single adjustable shoulder strap to be worn across the caregivers' shoulders. U.S. Pat. No. 3,841,543 by Bolton discloses a tubular sling-type carrier having a resilient, semi-rigid pad located between the layers of material of which the carrier is made. U.S. Pat. No. Des. 332,865 by Wilmink discloses a baby carrying bag having an adjustable shoulder strap and drawstrings. The Baby Book, by William Sears, M.D., & Martha Sears, R.N., 1993, chapter 14, discloses the use of a sling-type baby carrier and a variety of positions for use.

None of the above inventions and patents, taken either singularly or in combination, is seen to describe the instant invention as claimed. Thus a baby sling solving the aforementioned problems is desired.

SUMMARY OF THE INVENTION

The baby sling of the present invention has two rings, a pouch of a double layer of fabric, and a wide tail. The invention also includes bumpers and a pillow located between the pouch fabric layers. A baby is held in the pouch against the caregiver's body. The bumpers may have drawstrings attached. The tail may have a zippered pocket.

The rings are approximately toroidal in form and are approximately equal in size. The rings should not be able to pass through one another in any configuration. The rings preferably have an outer diameter of between 2 and 3½ inches and an inner diameter of between 1¾ and 3 inches because otherwise the tail slips too easily through larger rings. Likewise, for smaller rings, it can be difficult to fit the tail through. Most preferably the rings have an outer diameter of about 2⅜ inches and an inner diameter of about 2 inches. The rings preferably are made of metal or plastic, but other materials such as wood may be used. The rings should be durable and able to support 30–40 pounds. The rings may be ridged, preferably in a spiral pattern. The ridges help to prevent the tail slipping through the rings and provide even greater security.

The pouch is elongated and adapted to holding a baby. The pouch has two edges, a ring end, and a tail end. The pouch is attached to the rings at the ring end. The pouch is composed of a single piece of fabric, the piece of fabric being folded approximately in half at the ring end of the pouch to form two layers of fabric. The piece of fabric is preferably approximately rectangular in shape. The fabric is preferably a lightweight cotton, but may be any machine washable fabric. The piece of fabric passes through the two rings at the ring end of the pouch.

All of the seams holding the two layers together, including the stitching securing the bumpers and the pillow, contribute to holding the two rings in place.

Preferably the pouch has a length from the ring end to the tail end of between 48 and 60 inches. Most preferably the pouch length is about 54 inches, for an overall length of about 72 inches. This length provides for easy adjustment to fit either short or tall people. Moreover, manufacturing the sling in a variety of sizes is therefore not necessary. A scaled-down version may be used for children who wish to imitate a caregiver by carrying a doll in a sling.

The pouch width is between 31 and 48 inches, most preferably about 34 inches. The wide pouch provides greater security, making it unlikely that a baby will fall out, even if the baby squirms or arches his back. The wide pouch provides better support for the baby, especially for the baby's back. The greater security and better support make a greater variety of positions possible. A large baby or even a toddler can be carried securely on a caretaker's back. The wide pouch makes discreet breastfeeding easy, since extra fabric is available to pull over the baby. The wide pouch also makes it practical to carry items such as toys, extra diapers, or a caretaker's wallet securely in the sling. The eliminates the need to carry an additional bag for short excursions and helps to free up the caretaker's hands.

Since the pouch fabric is doubled, the stresses due to the weight of the baby are distributed throughout the carrier, instead of being concentrated at an attachment seam or seams near the rings. This improves the durability of the sling and makes the sling more comfortable for the baby and the caretaker. The two-layer design is very simple to manufacture. Most of the seams are side seams. The pillow and bumpers are simply inserted between the back side of the fabric does not show. The sling preferably is reversible. The two-layer design adds additional strength throughout the sling.

The baby sling has two bumpers. The bumpers are located between the fabric layers of the pouch. This simplifies the manufacture of the sling. Each bumper is located along one edge of the pouch. Each of the bumpers is approximately cylindrical in form. Each bumper preferably has a diameter between 1 inch and 2 inches and a length between 38 and 54 inches. The bumpers are composed of batting and held in place by stitching. Preferably the batting is non-allergenic. 6-ounce or 8-ounce polyester quilt batting may be used. Cotton batting may also be used. The bumper batting may be cut into strips, which are rolled into cylinders. The bumper batting is then stuffed between the layers of pouch fabric, and secured by stitching. Preferably the bumpers are firmly padded.

Each of the bumpers may have at least one drawstring attached. The drawstrings allow the bumpers to be gathered firmly around the baby for additional security.

The baby sling includes a pillow. The pillow is located between the fabric layers of the pouch. Since the pillow does not have to be added onto the exterior as would otherwise be done on a single layer, the manufacture of the sling is simplified. The pillow has a ring end and a tail end. The pillow preferably is located between one and five inches from the ring end of the pouch, most preferably about two inches. The pillow may be approximately rectangular in form. The pillow preferably has a length from the ring end to the tail end of between 9 and 12 inches, most preferably 10 inches. The width is between 6 and 9 inches, most preferably 7 inches. The thickness is between ½ inch and 1½ inches. The pillow is composed of the same type of batting as the bumpers. The pillow batting may be cut in 10 inch strips, doubled over, and inserted between the pouch fabric layers. The pillow batting is then held in place by stitching.

The baby sling of the present invention has a tail extending from the tail end of the pouch. The tail has a pouch end and a free end. The tail is composed of at least two layers of fabric. The tail may have a pocket located between the fabric layers of the tail, the pocket being releasably closed by a zipper.

The tail is approximately rectangular in form. Preferably the tail has a length from the pouch end to the free end of between 16 and 28 inches, and a width of between 7 and 48 inches. The wide tail fans out on either side of the rings. This prevents the tail slipping through the rings and helps to hold the carrier in place. No stiffening rod is required to prevent the tail from slipping through the rings. The wide tail is more comfortable on the caretaker's shoulders than the typical narrow tail.

In one preferred embodiment, the tail is composed of four layers of fabric, the tail has a length of about 19 inches and a width of about 8½ inches. In this embodiment, the edges of the pouch are folded towards each other at the tail end of the pouch and secured by stitching. The result is that the tail end of the pouch and the tail have approximately equal widths.

In the most preferred embodiment, the tail is composed of two layers of fabric. In this embodiment the fabric layers of the tail are continuous with the fabric layers of the pouch. The pouch and the tail have the same width of about 35 inches. This embodiment is completely reversible.

Accordingly, it is a principal object of the invention to provide a durable, sling-type baby carrier having a pouch of a double layer of fabric with no seams at the rings, and has the pillow and bumpers between the fabric layers.

It is another object of the invention to provide a baby carrier which is convenient, is comfortable for long periods for the caregiver and the baby, distributes the weight of the baby evenly, is easy to get the baby in and out of, and is easy for a caregiver to put on, take off, and adjust to size.

It is another object of the invention to provide a baby sling which promotes bonding, encourages good posture for a caregiver, and can be used in a variety of positions.

It is another object of the invention to provide a baby sling which can be used to carry babies from newborns up to two years or babies up to 30 pounds, holds the baby securely without slipping, is lightweight, folds and stores easily, and is easily adjustable for use by caregivers of any height.

It is a further object of the invention to provide a baby sling which is machine washable and easy to manufacture.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
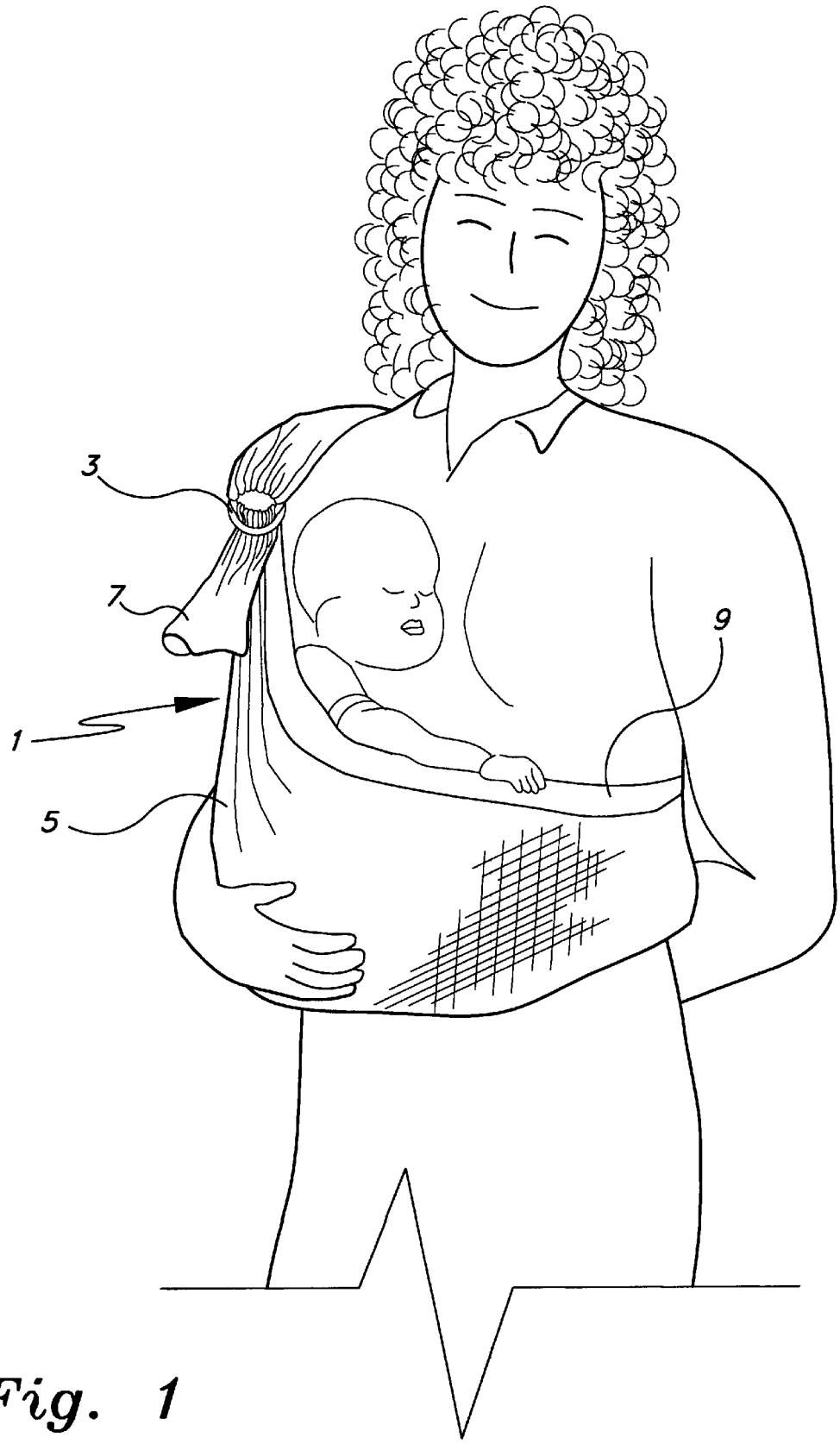
FIG. 1 is an environmental, perspective view of a baby sling in use according to the present invention.

FIG. 1 is an environmental, perspective view of a baby sling 1 in use according to the present invention. The baby sling 1 of the present invention has two rings 3, a pouch 5 of a double layer of fabric, and a tail 7. The invention also includes bumpers 9 between the pouch fabric layers. The baby is securely held in the pouch 5.

The baby sling 1 may be used in a variety of configurations. Generally for newborns or small babies the pillow is worn in the front. For larger babies the pillow is preferably worn with the pillow cushioning the caregiver's shoulder. In the configuration of FIG. 1, the pillow is cushioning the shoulder of the caregiver and so is not visible. The rings 3 are in front of the caregiver's shoulder with the tail 7 hanging down. The baby sling 1 may also be configured with the pillow cushioning the baby's head, with the baby lying down, with the baby held upright against the caregiver's shoulder, with the baby's legs hanging out, etc. The baby can be easily changed from one position to another.

Figure 2:
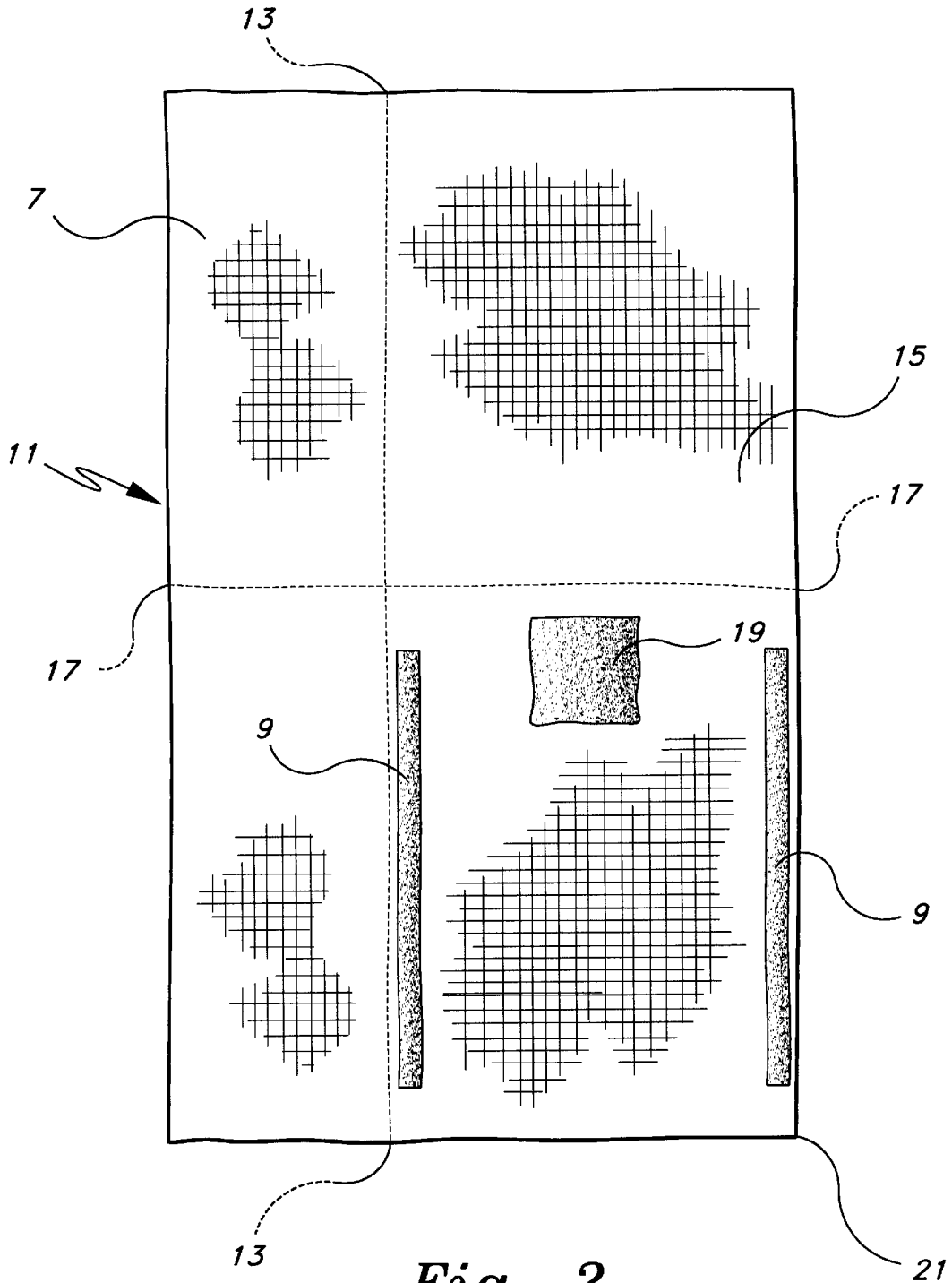
FIG. 2 is a top view of a pattern for a first embodiment of the baby sling.

FIG. 2 is a top view of a pattern for constructing the baby sling 1. The fabric 11 has the standard fabric width of about 45 inches and a length of about 108 inches, or 3 yards. The fabric 11 is cut along line 13—13. The resulting single piece of fabric 15 has a width of about 35 inches. The piece of fabric 15 is folded approximately in half along line 17—17. Line 17—17 is the ring end of the pouch 5. The bumpers 9 and the pillow 19 are located between the fabric layers of the pouch 5. The resulting pouch 5 has a width of about 34 inches. The remainder of the fabric 11 is folded twice lengthwise to form the tail 7, and sewn to the tail end 21 of the pouch 5. The tail 7 therefore has four layers of fabric.

Figure 3:
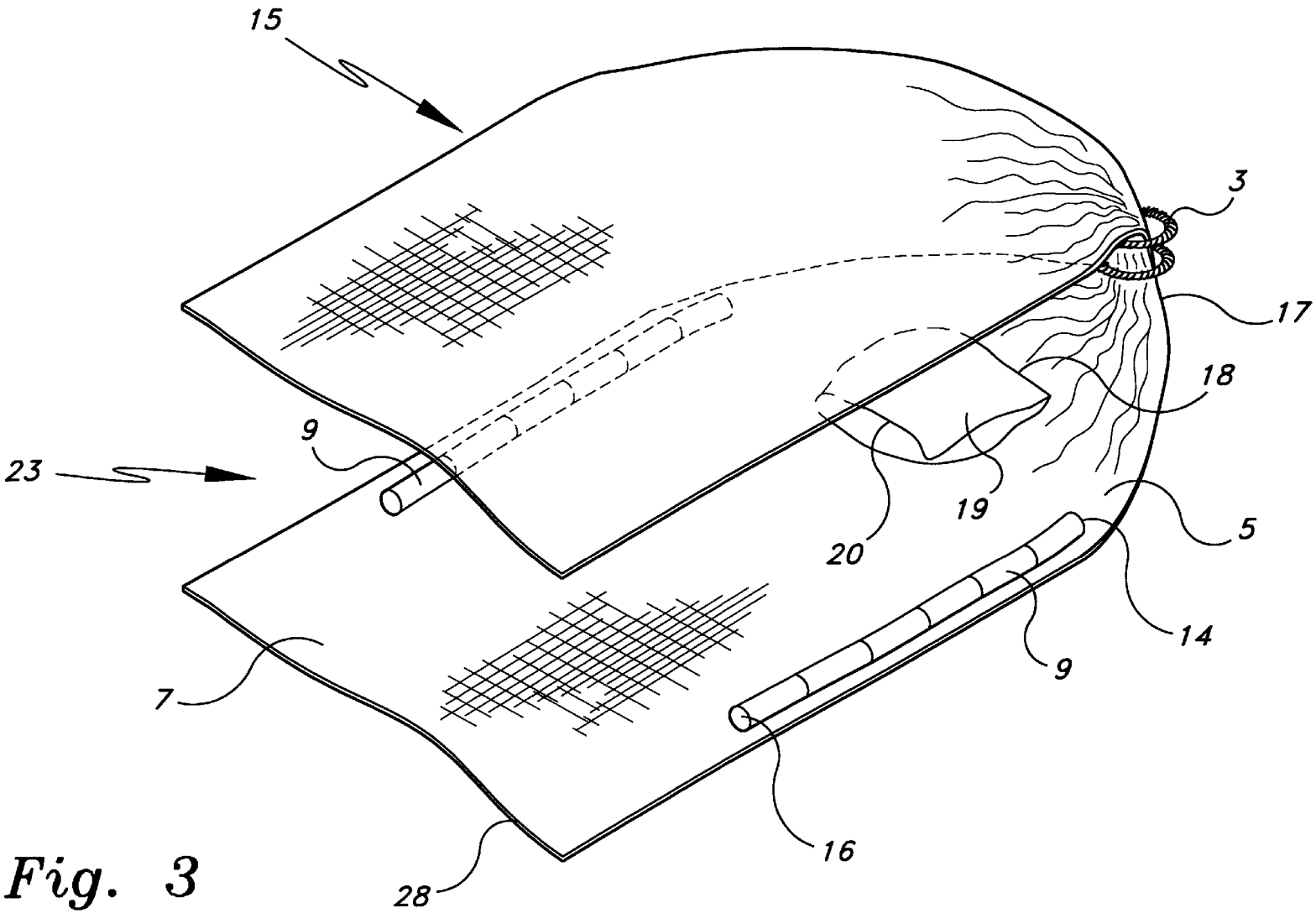
FIG. 3 is an exploded, perspective view of a second embodiment of the baby sling.

FIG. 3 is an exploded, perspective view of a second embodiment 23 of the baby sling. The piece of fabric 15 has two layers forming the pouch 5 and the tail 7. The overall length of the piece of fabric 15 is about 4½ yards. The fabric layers are continuous between the pouch 5 and the tail 7. The fabric layers forming the pouch 5 and the tail 7 have the same width of about 35 inches. The full standard fabric width of 45 inches may also be used. The bumpers 9 and the pillow 19 are located between the fabric layers of the pouch 5. The bumpers 9 are made of rolled quilt batting and are approximately cylindrical. The bumpers have a ring end 14 and a tail end 16. The fabric layers extend about 27 inches from the tail end 16 of the bumpers 9 to the free end 28 of the tail 7. The pillow 19 is made of quilt batting and has a ring end 18 and a tail end 20. The piece of fabric 15 passes through the rings 3 and folds approximately in half at the ring end 17 of the pouch 5. The rings 3 have an outer diameter of about 2⅜ inches and an inner diameter of about 2 inches.

Figure 4:
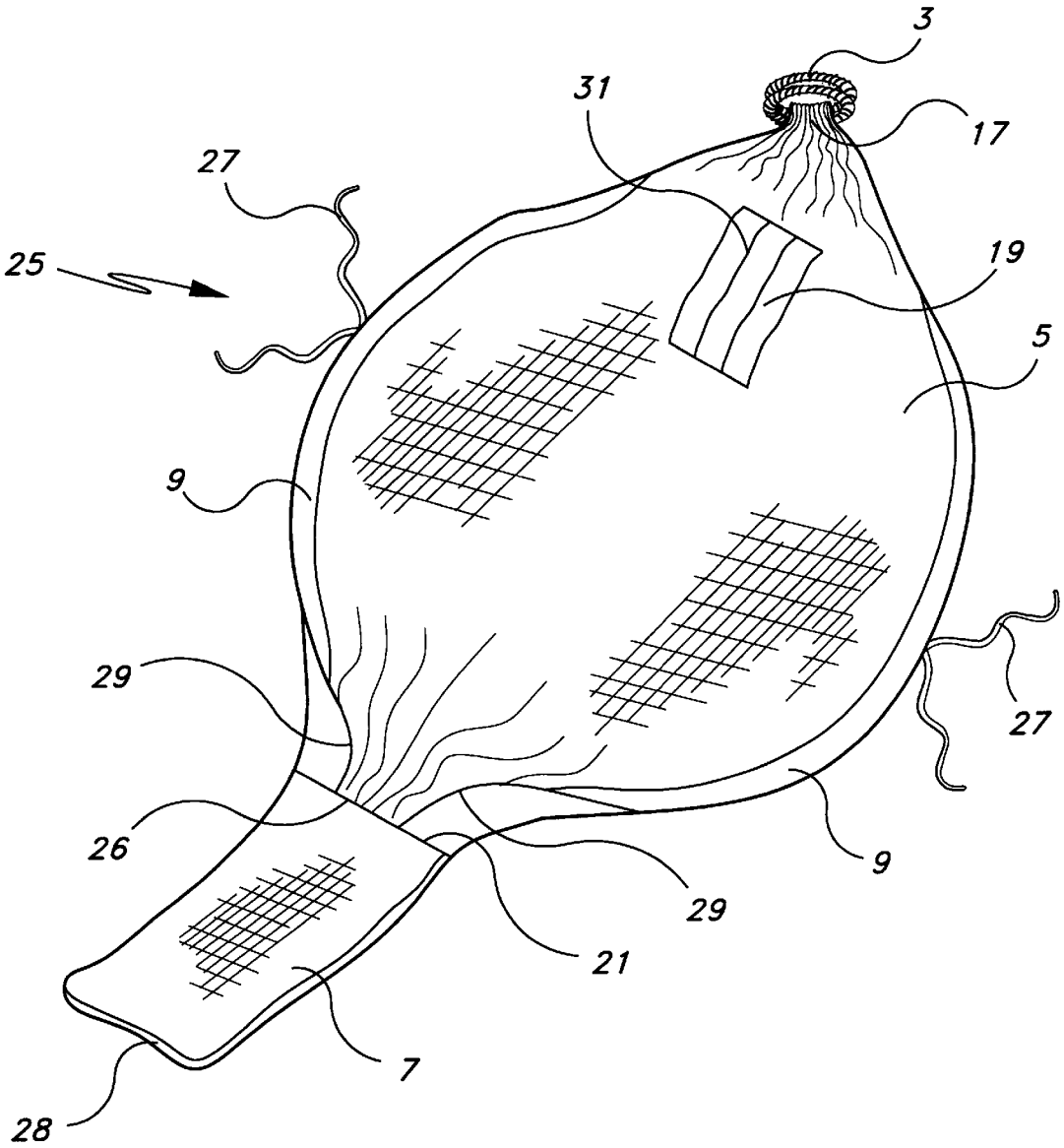
FIG. 4 is a perspective view of a third embodiment of the baby sling.

FIG. 4 is a perspective view of the third embodiment 25 of the baby sling. The third embodiment 25 is identical to the first embodiment 1 but includes drawstrings 27 attached to each of the bumpers 9. The third embodiment 25 is constructed from the pattern of FIG. 2. The wide tail 7 is attached to the tail end 21 of the pouch 5. The tail 7 has a pouch end 26 and a free end 28. The edges 29 of the pouch 5 are folded towards each other at the tail end 21 and secured by stitching so that the tail end 21 and the tail 7 have approximately equal widths. The bumpers 9 and pillow 19 are located between the fabric layers of the pouch 5. The pillow 19 is secured by stitching 31 through the pillow batting and the fabric layers. The rings 3 are ridged in a spiral pattern to provide extra security against slipping of the tail.

Figure 5:
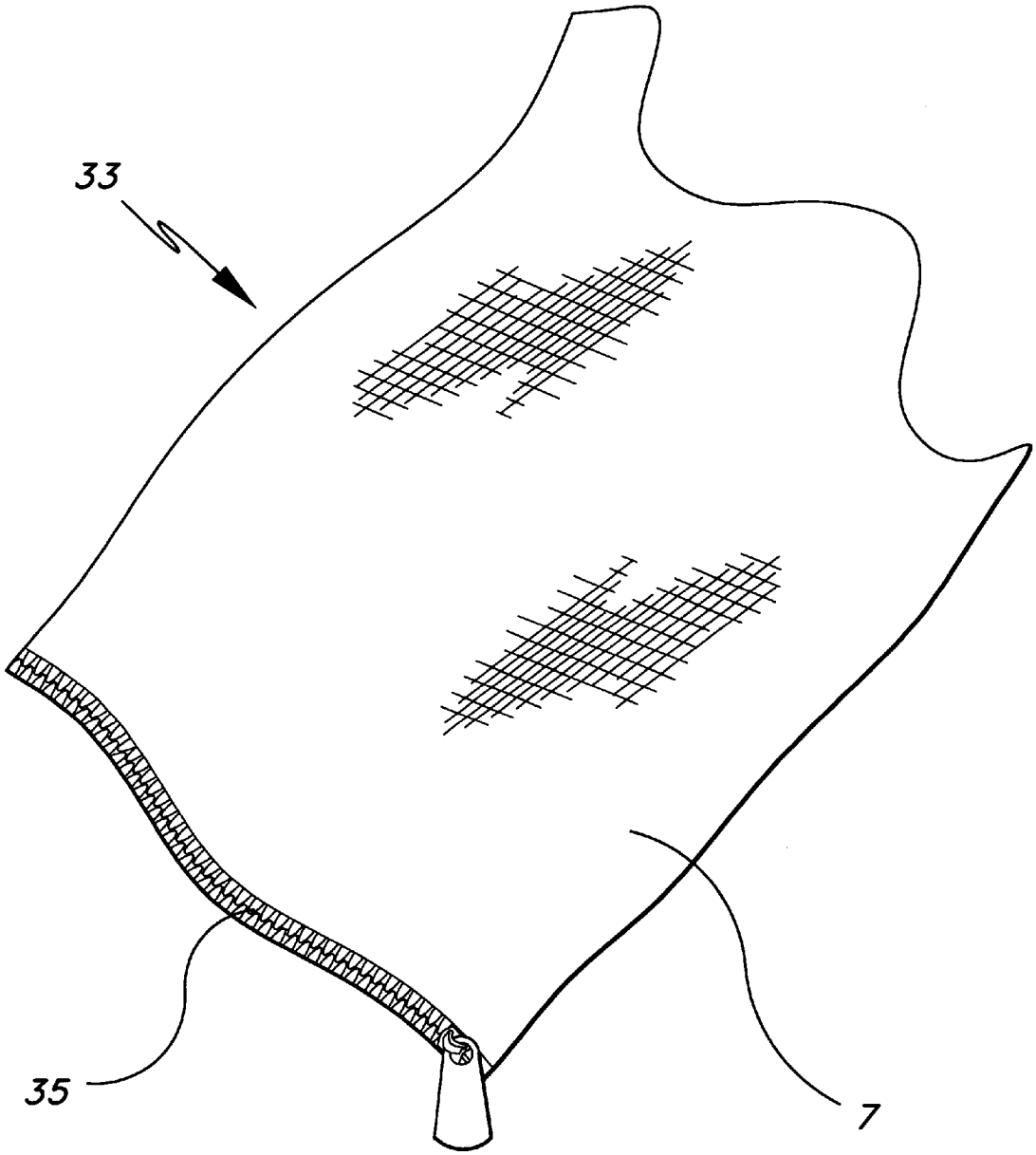
FIG. 5 is a detail view of a fourth embodiment of the baby sling.

FIG. 5 is a detail view of a fourth embodiment 33 of the baby sling. The baby sling 33 includes a pocket located between the fabric layers of the tail 7. The pocket is releasably closed by a zipper 35. This provides an attractive optional storage feature in a location which does not interfere with the carrying of the baby or the comfort of the user.

As can now be understood, since the pouch fabric is doubled, the stresses due to the weight of the baby are distributed throughout the carrier, instead of being concentrated at an attachment seam or seams near the rings. This improves the durability of the sling and makes the sling more comfortable for the baby and the caretaker. The two-layer design is very simple to manufacture. Most of the seams are side seams, thereby eliminating weaknesses. The pillow and bumpers are simply inserted between the layers instead of having to form individual pockets for the bumpers. The two-layer design also is more attractive, since the back side of the fabric does not show and the sling may be made reversible with alternate designs. The two-layer design also just generally adds strength throughout the sling.

It is to be understood that the present invention is not limited to the embodiments described above, but encompasses any and all embodiments within the scope of the following claims.

I claim:

1. A baby sling comprising:

(a) two rings, the rings being approximately toroidal in form and having approximately equal size;

(b) an elongated pouch adapted to holding a baby, the pouch having two edges, a ring end, and a tail end, the pouch being attached to the rings at the ring end, the pouch being composed of a single piece of fabric, the piece of fabric being folded approximately in half at the ring end of the pouch to form two layers of fabric, the piece of fabric passing through the two rings at the ring end of the pouch;

(c) two bumpers, the bumpers being located between the fabric layers of the pouch, each bumper being located along one edge of the pouch, each bumper being approximately cylindrical in form;

(d) a pillow, the pillow being located between the fabric layers of the pouch, and having a ring end and a tail end; and (e) a tail extending from the tail end of the pouch, the tail having a pouch end and a free end, the tail being composed of at least two layers of fabric.

2. The baby sling according to claim 1, further comprising at least one drawstring attached to each of the bumpers.

3. The baby sling according to claim 1, wherein:

(a) the rings have an outer diameter of between 2 and 3½ inches and an inner diameter of between 1¾ and 3 inches;

(b) the pouch has a length from the ring end to the tail end of between 48 and 60 inches and a width of between 31 and 48 inches, the piece of fabric composing the pouch being approximately rectangular in form;

(c) each bumper has a diameter between 1 inch and 2 inches and a length between 38 and 54 inches, each bumper is composed of batting, and the bumper batting is held in place by stitching;

(d) the pillow is located between one and five inches from the ring end of the pouch, the pillow is approximately rectangular in form, the pillow has a length from the ring end to the tail end of between 9 and 12 inches, a width of between 7 and 9 inches, and a thickness of between ½ inch and 1½ inches, and the pillow is composed of batting, the pillow batting being held in place by stitching; and (e) the tail is approximately rectangular in form, and the tail has a length from the pouch end to the free end of between 16 and 28 inches and a width of between 7 and 48 inches.

4. The baby sling according to claim 3, wherein the pouch has a length of about 54 inches and a width of about 34 inches, the pillow is located about 2 inches from the ring end of the pouch, the pillow has a length of about 10 inches and a width of about 7 inches, the tail is composed of four layers of fabric, the tail has a length of about 19 inches and a width of about 8½ inches, and the edges of the pouch are folded towards each other at the tail end of the pouch and secured by stitching so that the tail end of the pouch and the tail have approximately equal widths.

5. The baby sling according to claim 3, wherein the tail is composed of two layers of fabric, the tail has a width of about 35 inches, and the fabric layers of the tail are continuous with the fabric layers of the pouch.

6. The baby sling according to claim 3, wherein the rings are composed of a material selected from the group consisting of metal and plastic, the rings have an outer diameter of about 2⅜ inches and an inner diameter of about 2 inches, and the rings are ridged in a spiral pattern.

7. The baby sling according to claim 3, further comprising a pocket located between the fabric layers of the tail, the pocket being releasably closed by a zipper.

* * * * *